US007448522B2

(12) United States Patent
Collier et al.

(10) Patent No.: US 7,448,522 B2
(45) Date of Patent: Nov. 11, 2008

(54) FLUID-FILLED BLADDER FOR USE WITH STRAP

(75) Inventors: Michael Collier, Portland, OR (US); Randall S. Wolfe, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 536 days.

(21) Appl. No.: 10/705,731

(22) Filed: Nov. 11, 2003

(65) Prior Publication Data

US 2005/0098590 A1 May 12, 2005

(51) Int. Cl.
*A45F 3/12* (2006.01)
*A41F 15/02* (2006.01)

(52) U.S. Cl. ..... 224/264; 224/643

(58) Field of Classification Search ..... 224/642, 224/643, 264, 907; 36/29, 141; 602/13; 441/114, 117
See application file for complete search history.

(56) References Cited

U.S. PATENT DOCUMENTS

| | | | | |
|---|---|---|---|---|
| 900,867 | A | 10/1908 | Miller | |
| 1,069,001 | A | 7/1913 | Guy | |
| 1,240,153 | A | 9/1917 | Olsen | |
| 1,304,915 | A | 5/1919 | Spinney | |
| 1,323,610 | A | 12/1919 | Price | |
| 1,444,157 | A | 2/1923 | Lee | |
| 1,514,468 | A | 11/1924 | Schopf | |
| 1,538,627 | A * | 5/1925 | Benvenuto | 441/114 |
| 1,546,067 | A * | 7/1925 | Goldschmidt | 224/264 |
| 1,584,034 | A | 5/1926 | Klotz | |
| 1,625,582 | A | 4/1927 | Anderson | |
| 1,625,810 | A | 4/1927 | Krichbaum | |
| 1,631,694 | A * | 6/1927 | George | 224/264 |
| 1,651,921 | A * | 12/1927 | Felz | 224/240 |
| 1,869,257 | A | 7/1932 | Hitzler | |
| 1,916,483 | A | 7/1933 | Krichbaum | |
| 1,970,803 | A | 8/1934 | Johnson | |
| 2,004,906 | A | 6/1935 | Simister | |
| 2,080,469 | A | 5/1937 | Gilbert | |
| 2,086,389 | A | 7/1937 | Pearson | |
| 2,269,342 | A | 1/1942 | Johnson | |

(Continued)

FOREIGN PATENT DOCUMENTS

| | | |
|---|---|---|
| AT | 181938 | 2/1906 |

(Continued)

OTHER PUBLICATIONS

Brooks Running Catalog, Fall 1991.

(Continued)

*Primary Examiner*—Nathan J Newhouse
*Assistant Examiner*—Justin M Larson
(74) *Attorney, Agent, or Firm*—Banner & Witcoff, Ltd.

(57) ABSTRACT

A bladder for use with a strap to carry a load includes a first longitudinal chamber, a second longitudinal chamber spaced apart from and substantially parallel to the first longitudinal chamber, and a plurality of transverse chambers. Each transverse chamber is connected at a first end thereof to the first longitudinal chamber and at a second end thereof to the second longitudinal chamber, is in fluid communication with the first and second longitudinal chambers, and has a longitudinal axis extending substantially parallel to the longitudinal axis of the other transverse chambers.

22 Claims, 9 Drawing Sheets

U.S. PATENT DOCUMENTS

| | | | | |
|---|---|---|---|---|
| 2,365,807 | A | | 12/1944 | Dialynas |
| 2,488,382 | A | | 11/1949 | Davis |
| 2,546,827 | A | | 3/1951 | Lavinthal |
| 2,600,239 | A | | 6/1952 | Gilbert |
| 2,645,865 | A | | 7/1953 | Town |
| 2,677,906 | A | | 5/1954 | Reed |
| 2,703,770 | A | | 3/1955 | Melzer |
| 2,748,401 | A | | 6/1956 | Winstead |
| 2,762,134 | A | | 9/1956 | Town |
| 3,030,640 | A | | 4/1962 | Gosman |
| 3,048,514 | A | | 8/1962 | Bentele et al. |
| 3,120,712 | A | | 2/1964 | Menken |
| 3,121,430 | A | | 2/1964 | O'Reilly |
| 3,134,995 | A | * | 6/1964 | Kirchner ..... 441/117 |
| 3,204,678 | A | | 9/1965 | Worcester |
| 3,251,076 | A | | 5/1966 | Burke |
| 3,284,264 | A | | 11/1966 | O'Rourke |
| 3,335,045 | A | | 8/1967 | Post |
| 3,366,525 | A | | 1/1968 | Jackson |
| 3,469,576 | A | | 9/1969 | Smith et al. |
| 3,568,227 | A | | 3/1971 | Dunham |
| 3,589,037 | A | | 6/1971 | Gallagher |
| 3,608,215 | A | | 9/1971 | Fukuoka |
| 3,685,176 | A | | 8/1972 | Rudy |
| 3,758,964 | A | | 9/1973 | Nishimura |
| 3,765,422 | A | | 10/1973 | Smith |
| 3,883,053 | A | * | 5/1975 | Pritchard et al. ..... 224/264 |
| 4,017,931 | A | | 4/1977 | Golden |
| 4,054,960 | A | | 10/1977 | Pettit et al. |
| 4,094,014 | A | * | 6/1978 | Schroeder ..... 2/161.8 |
| 4,115,934 | A | | 9/1978 | Hall |
| 4,129,951 | A | | 12/1978 | Petrosky |
| 4,167,795 | A | | 9/1979 | Lambert, Jr. |
| 4,183,156 | A | | 1/1980 | Rudy |
| 4,187,620 | A | | 2/1980 | Seiner |
| 4,217,705 | A | | 8/1980 | Donzis |
| 4,219,945 | A | | 9/1980 | Rudy |
| 4,271,606 | A | | 6/1981 | Rudy |
| 4,287,250 | A | | 9/1981 | Rudy |
| 4,292,702 | A | | 10/1981 | Phillips |
| 4,297,797 | A | | 11/1981 | Meyers |
| 4,305,212 | A | | 12/1981 | Coomer |
| 4,328,599 | A | | 5/1982 | Mollura |
| 4,358,902 | A | | 11/1982 | Cole et al. |
| 4,431,003 | A | | 2/1984 | Sztancsik |
| 4,446,634 | A | | 5/1984 | Johnson et al. |
| 4,458,430 | A | | 7/1984 | Peterson |
| 4,483,030 | A | | 11/1984 | Plick et al. |
| 4,486,964 | A | | 12/1984 | Rudy |
| 4,506,460 | A | | 3/1985 | Rudy |
| 4,547,919 | A | | 10/1985 | Wang |
| 4,662,087 | A | | 5/1987 | Beuch |
| 4,670,995 | A | | 6/1987 | Huang |
| 4,686,130 | A | | 8/1987 | Kon |
| 4,722,131 | A | | 2/1988 | Huang |
| 4,744,157 | A | | 5/1988 | Dubner |
| 4,779,359 | A | | 10/1988 | Famolare, Jr. |
| 4,782,602 | A | | 11/1988 | Lakic |
| 4,803,029 | A | | 2/1989 | Iversen et al. |
| 4,817,304 | A | | 4/1989 | Parker et al. |
| 4,823,482 | A | | 4/1989 | Lakic |
| 4,845,338 | A | | 7/1989 | Lakic |
| 4,845,861 | A | | 7/1989 | Moumgdgian |
| 4,874,640 | A | | 10/1989 | Donzis |
| 4,891,855 | A | | 1/1990 | Cheng-Chung |
| 4,906,502 | A | | 3/1990 | Rudy |
| 4,912,861 | A | | 4/1990 | Huang |
| 4,936,029 | A | | 6/1990 | Rudy |
| 4,965,899 | A | | 10/1990 | Sekido et al. |
| 4,972,611 | A | | 11/1990 | Swartz et al. |
| 4,991,317 | A | | 2/1991 | Lakic |
| 4,999,931 | A | | 3/1991 | Vermeulen |
| 4,999,932 | A | | 3/1991 | Grim |
| 5,014,449 | A | | 5/1991 | Richard et al. |
| 5,022,109 | A | | 6/1991 | Pekar |
| 5,025,575 | A | | 6/1991 | Lakic |
| 5,038,984 | A | | 8/1991 | Izzo |
| 5,042,176 | A | | 8/1991 | Rudy |
| 5,044,030 | A | | 9/1991 | Balaton |
| 5,046,267 | A | | 9/1991 | Kilgore et al. |
| 5,083,361 | A | | 1/1992 | Rudy |
| 5,104,477 | A | | 4/1992 | Williams et al. |
| 5,155,927 | A | | 10/1992 | Bates et al. |
| 5,158,767 | A | | 10/1992 | Cohen et al. |
| 5,179,792 | A | | 1/1993 | Brantingham |
| 5,193,246 | A | | 3/1993 | Huang |
| 5,199,191 | A | | 4/1993 | Moumdjian |
| D336,772 | S | * | 6/1993 | Forland et al. ..... D2/961 |
| 5,224,277 | A | | 7/1993 | Sang Do |
| 5,224,278 | A | | 7/1993 | Jeon |
| 5,228,156 | A | | 7/1993 | Wang |
| 5,235,715 | A | | 8/1993 | Donzis |
| 5,238,231 | A | | 8/1993 | Huang |
| 5,245,766 | A | | 9/1993 | Warren |
| 5,253,435 | A | | 10/1993 | Auger et al. |
| 5,257,470 | A | | 11/1993 | Auger et al. |
| 5,294,183 | A | * | 3/1994 | Wetter et al. ..... 297/472 |
| 5,297,349 | A | | 3/1994 | Kilgore |
| 5,335,382 | A | | 8/1994 | Huang |
| 5,337,492 | A | | 8/1994 | Anderie et al. |
| D351,056 | S | * | 10/1994 | Auger et al. ..... D2/961 |
| 5,353,523 | A | | 10/1994 | Kilgore et al. |
| 5,355,552 | A | | 10/1994 | Huang |
| 5,361,957 | A | | 11/1994 | Weintraub |
| 5,367,791 | A | | 11/1994 | Gross et al. |
| 5,406,719 | A | | 4/1995 | Potter |
| 5,425,184 | A | | 6/1995 | Lyden et al. |
| 5,435,647 | A | | 7/1995 | Oliver |
| 5,543,194 | A | | 8/1996 | Rudy |
| 5,558,395 | A | | 9/1996 | Huang |
| 5,566,871 | A | | 10/1996 | Weintraub |
| 5,572,804 | A | | 11/1996 | Skaja et al. |
| 5,593,077 | A | | 1/1997 | Izzo |
| 5,595,004 | A | | 1/1997 | Lyden et al. |
| 5,625,964 | A | | 5/1997 | Lyden et al. |
| 5,669,161 | A | | 9/1997 | Huang |
| 5,686,167 | A | | 11/1997 | Rudy |
| 5,713,141 | A | | 2/1998 | Mitchell et al. |
| 5,728,055 | A | * | 3/1998 | Sebastian ..... 602/19 |
| 5,741,568 | A | | 4/1998 | Rudy |
| 5,753,061 | A | | 5/1998 | Rudy |
| 5,755,001 | A | | 5/1998 | Potter et al. |
| 5,771,606 | A | | 6/1998 | Litchfield et al. |
| 5,802,739 | A | | 9/1998 | Potter et al. |
| 5,830,553 | A | | 11/1998 | Huang |
| 5,832,630 | A | | 11/1998 | Potter |
| 5,846,063 | A | | 12/1998 | Lakic |
| 5,902,660 | A | | 5/1999 | Huang |
| 5,907,911 | A | | 6/1999 | Huang |
| 5,916,664 | A | | 6/1999 | Rudy |
| 5,925,306 | A | | 7/1999 | Huang |
| 5,937,462 | A | | 8/1999 | Huang |
| 5,952,065 | A | | 9/1999 | Mitchell et al. |
| 5,976,451 | A | | 11/1999 | Skaja et al. |
| 5,979,078 | A | | 11/1999 | McLaughlin |
| 5,987,780 | A | | 11/1999 | Lyden et al. |
| 5,993,585 | A | | 11/1999 | Goodwin et al. |
| 6,013,340 | A | | 1/2000 | Bonk et al. |
| 6,027,683 | A | | 2/2000 | Huang |
| 6,029,962 | A | | 2/2000 | Shorten et al. |
| 6,055,746 | A | | 5/2000 | Lyden et al. |
| 6,065,150 | A | | 5/2000 | Huang |
| 6,098,313 | A | | 8/2000 | Skaja |
| 6,109,495 | A | | 8/2000 | Hernandez |

| | | | | |
|---|---|---|---|---|
| 6,119,371 | A | 9/2000 | Goodwin et al. | |
| 6,127,010 | A | 10/2000 | Rudy | |
| 6,128,837 | A | 10/2000 | Huang | |
| 6,152,343 | A | 11/2000 | Shin | |
| 6,168,060 | B1 | 1/2001 | Mayers | |
| 6,220,492 | B1 * | 4/2001 | Huang | 224/264 |
| 6,223,959 | B1 | 5/2001 | Chen | |
| 6,253,466 | B1 | 7/2001 | Harmon-Weiss et al. | |
| 6,279,795 | B1 * | 8/2001 | Pierzina | 224/150 |
| D448,170 | S * | 9/2001 | Ammerman et al. | D3/327 |
| 6,318,609 | B1 * | 11/2001 | Swierz | 224/264 |
| 6,374,514 | B1 | 4/2002 | Swigart | |
| 6,467,661 | B1 * | 10/2002 | Mistretta et al. | 224/264 |
| 6,471,105 | B1 | 10/2002 | Ammerman et al. | |
| 6,640,344 | B2 * | 11/2003 | D'Addario et al. | 2/268 |
| 6,644,522 | B2 * | 11/2003 | Preiss | 224/264 |
| 6,857,627 | B2 * | 2/2005 | Gordon | 269/21 |
| 6,910,227 | B2 * | 6/2005 | Lee | 2/268 |
| 6,915,932 | B1 * | 7/2005 | Wolfe | 224/264 |
| 7,004,363 | B2 * | 2/2006 | Fenton et al. | 224/264 |
| 2004/0144816 | A1 * | 7/2004 | Ku | 224/264 |

FOREIGN PATENT DOCUMENTS

| | | | |
|---|---|---|---|
| AT | 200963 | | 12/1958 |
| CA | 727582 | | 2/1966 |
| CN | 75100322 | | 1/1975 |
| CN | 54221 | | 6/1978 |
| DE | 32 34 086 | | 9/1982 |
| DE | 92 01 758.4 | | 12/1992 |
| EP | 0 094 868 | | 5/1983 |
| EP | 0 215 974 | A1 | 9/1985 |
| EP | 0 605 485 | B1 | 9/1992 |
| EP | 0 898 906 | A2 | 3/1999 |
| EP | 0898906 | A2 * | 9/1999 |
| FR | 1195549 | | 11/1959 |
| FR | 1406610 | | 11/1965 |
| FR | 2144464 | | 1/1973 |
| FR | 2406402 | | 10/1978 |
| FR | 2404413 | | 4/1979 |
| FR | 2407008 | | 5/1979 |
| FR | 2483321 | | 4/1981 |
| FR | 2614510 | | 4/1987 |
| FR | 2639537 | | 11/1988 |
| GB | 14955 | | 8/1893 |
| GB | 7441 | | 3/1906 |
| GB | 233387 | | 1/1924 |
| GB | 978654 | | 12/1964 |
| GB | 1128764 | | 10/1968 |
| GB | 2328604 | A | 3/1999 |
| JP | 266718 | | 9/1992 |
| JP | 6-181802 | | 7/1994 |
| WO | WO89/10074 | | 11/1989 |
| WO | WO90/10396 | | 9/1990 |
| WO | WO91/11928 | | 8/1991 |
| WO | WO91/11931 | | 8/1991 |
| WO | WO92/08384 | | 5/1992 |
| WO | WO95/20332 | | 8/1995 |
| WO | WO98/17144 | | 4/1998 |
| WO | WO01/50909 | A1 | 7/2001 |
| WO | WO0247510 | A1 * | 6/2002 |

OTHER PUBLICATIONS

Dyna-Disc Exercises; Lifestyle Sports; hhtp://lifestylesport.com/dyna-disc.htm; date unknown.

Sports Research Review, NIKE, Inc., Jan./Feb. 1990.

Three photographs of backpack manufactured by NIKE, Inc. and publicly disclosed in 2001.

U.S. Appl. No. 10/341,773, filed Jan. 13, 2003.

* cited by examiner

FLUID-FILLED BLADDER FOR USE WITH STRAP

FIELD OF THE INVENTION

This invention relates generally to a fluid-filled bladder, and, in particular, to a fluid-filled bladder for use with a strap to carry a load.

BACKGROUND OF THE INVENTION

Bags are often provided with one or more straps to assist individuals carrying the bag. For example, backpacks typically have a pair of shoulder straps to allow an individual to carry the backpack. Golf bags are typically provided with one, and sometimes two, straps that allow the bag to be carried over the shoulder or shoulders of an individual. Messenger bags, such as those used by bicycle messengers, are typically provided with a single strap, with the strap strung around the neck of the user and resting on their shoulder. Backpacks, golf bags, and other bags, when fully loaded, can be quite heavy. Consequently, providing comfortable straps is considered highly desirable. Such straps typically consist of a length of webbing that connects at either end to the bag, and include padding along a central section of the strap. The padding may consist of a soft fiber, or may include an air-filled bladder.

U.S. Pat. No. 6,223,959 discloses a strap that is connected at either end to a bag. A central portion of the strap includes an air pocket formed of a plurality of non-communicating air chambers. Since the chambers do not communicate with one another, there can be no compensation for different weights and pressure points throughout the air pocket. Such a strap is limited in the amount of pressure distribution it can achieve, and is not able to conform about the surface of the user's shoulder, which may lead to fatigue and discomfort for the wearer.

It is an object of the present invention to provide a fluid-filled bladder for use with a strap to carry a load that reduces or wholly overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

In accordance with a first aspect, a bladder for use with a strap to carry a load includes a first longitudinal chamber, a second longitudinal chamber spaced apart from and substantially parallel to the first longitudinal chamber, and a plurality of transverse chambers. Each transverse chamber is connected at a first end thereof to the first longitudinal chamber and at a second end thereof to the second longitudinal chamber, is in fluid communication with the first and second longitudinal chambers, and has a longitudinal axis extending substantially parallel to the longitudinal axis of the other transverse chambers.

In accordance with another aspect, a strap for a device carrying a load includes a pad having a central aperture formed therein and a fluid-filled bladder positioned within the central aperture and secured to the pad. A length of webbing is slidably connected to first and second ends of the pad.

In accordance with a further aspect, bag carrying device includes a bag and a length of webbing connected at opposed ends thereof to the bag. A pad has a central aperture formed therein, and the length of webbing is slidably secured to first and second ends of the pad. A fluid-filled bladder is positioned within the central aperture and secured to the pad. The bladder includes a first longitudinal chamber, a second longitudinal chamber spaced apart from and substantially parallel to the first longitudinal chamber, and a plurality of transverse chambers. Each transverse chamber is connected at a first end thereof to the first longitudinal chamber and at a second end thereof to the second longitudinal chamber, is in fluid communication with the first and second longitudinal chambers, and has a longitudinal axis extending substantially parallel to the longitudinal axis of the other transverse chambers. A flange portion surrounds the first and second longitudinal chambers and is secured to the pad. Each of a plurality of elongate transverse apertures is disposed between adjacent transverse chambers, has a longitudinal axis extending substantially parallel to a longitudinal axis of each of the other transverse apertures, and is positioned at an angle with respect to a longitudinal axis of the bladder.

In accordance with yet another aspect, a bladder for use with a strap to carry a load includes a serpentine chamber formed of plurality of longitudinal chambers and a plurality of transverse chambers. Each transverse chamber is connected at ends thereof to, and is in fluid communication with, corresponding longitudinal chambers. A flange portion surrounds the serpentine chamber. An elongate first flange aperture is formed in the flange portion proximate an endmost transverse chamber. An elongate second flange aperture is formed in the flange proximate an opposed endmost transverse chamber and has a longitudinal axis extending substantially parallel to a longitudinal axis of the first flange aperture. A longitudinal axis of each of the first and second flange apertures is disposed at an angle with respect to a longitudinal axis of the bladder. Each of a plurality of elongate transverse apertures is disposed between adjacent transverse chambers and has a longitudinal axis extending substantially parallel to a longitudinal axis of each of the other transverse apertures. The longitudinal axis of each transverse aperture is disposed at an angle with respect to a longitudinal axis of the bladder.

In accordance with yet a further aspect, a bladder for use with a strap to carry a load includes at least one longitudinal chamber and a plurality of transverse chambers. Each transverse chamber is connected at a first end thereof to at least one longitudinal chamber, is in fluid communication with the at least one longitudinal chamber and each other transverse chamber, and has a longitudinal axis extending substantially parallel to the longitudinal axis of the other transverse chambers.

Substantial advantage is achieved by providing a fluid-filled bladder for use with a bag-carrying strap. In particular, the fluid-filled bladder can provide superior cushioning, excellent pressure distribution, and improved ergonomic fit. Consequently, a user can carry heavy loads with less fatigue and discomfort, allowing a bag to be more easily carried by individuals.

These and additional features and advantages of the invention disclosed here will be further understood from the following detailed disclosure of certain preferred embodiments.

Figure 1:
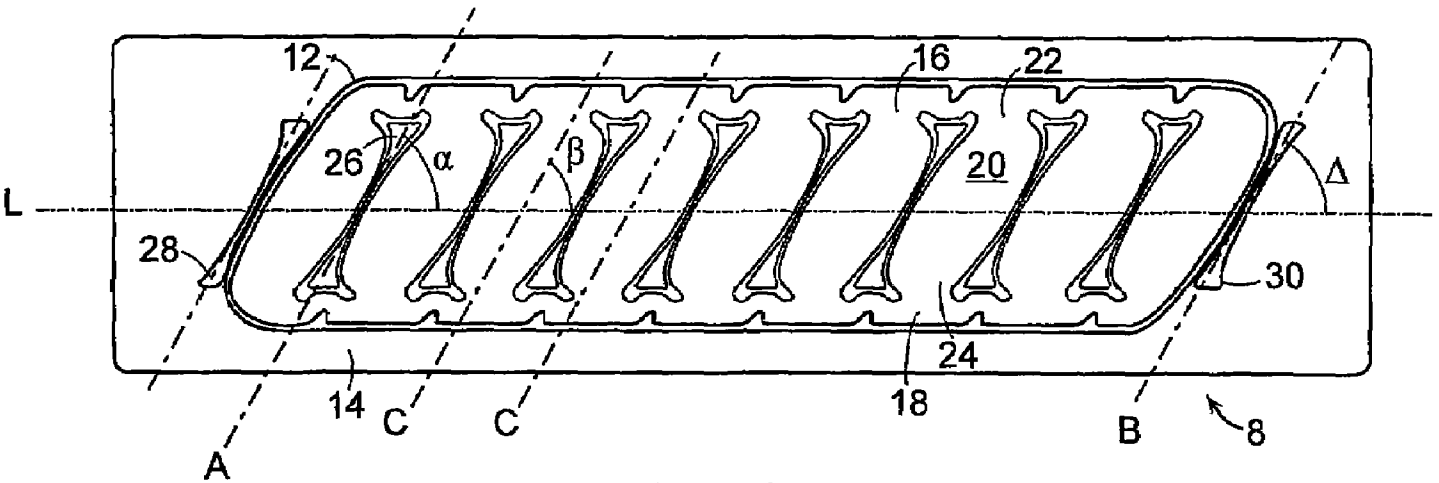
FIG. 1 is a plan view of a fluid-filled bladder in accordance with a preferred embodiment of the present invention.

The figures referred to above are not drawn necessarily to scale and should be understood to present a representation of the invention, illustrative of the principles involved. Some features of the fluid-filled bladder for use with a strap depicted in the drawings have been enlarged or distorted relative to others to facilitate explanation and understanding. The same reference numbers are used in the drawings for similar or identical components and features shown in various alternative embodiments. Fluid-filled bladders for use with a strap as disclosed herein, would have configurations and components determined, in part, by the intended application and environment in which they are used.

DETAILED DESCRIPTION OF CERTAIN PREFERRED EMBODIMENTS

Figure 2:
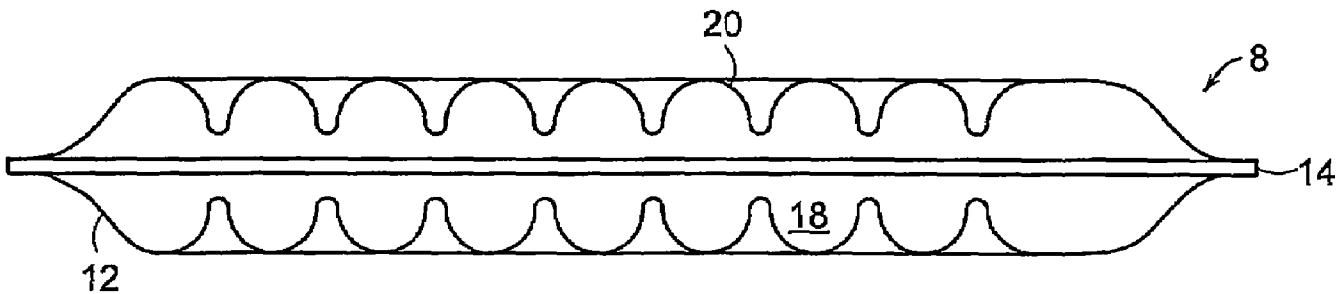
FIG. 2 is a side elevation view of the fluid-filled bladder of FIG. 1.

The present invention may be embodied in various forms. A preferred embodiment of a bladder 8 for use with a strap for a bag is shown in FIGS. 1-2. Bladder 8 has a chamber 12 that may be filled with a fluid, for example, air. A flange 14 extends around the peripheral edge of bladder 8, surrounding chamber 12. Flange 14 provides a surface with which to attach bladder 8 to a strap, as described below in greater detail.

Bladder 8 may be formed of a polymer material, such as a thermoplastic elastomer, that is substantially impermeable to fluid. More specifically, the material forming bladder 8 may be, for example, a film formed of alternating layers of thermoplastic polyurethane and ethylene-vinyl alcohol copolymer, as disclosed in U.S. Pat. Nos. 5,713,141 and 5,952,065 to Mitchell et al, each of which is incorporated herein by reference. A variation upon this material includes a center layer formed of ethylene-vinyl alcohol copolymer; two layers adjacent to the center layer that are formed of thermoplastic polyurethane; and outer layers formed of a regrind material of thermoplastic polyurethane and ethylene-vinyl alcohol copolymer. Another suitable material is a flexible microlayer membrane that includes alternating layers of a gas barrier material and an elastomeric material, as disclosed in U.S. Pat. Nos. 6,082,025 and 6,127,026 to Bonk et al., each of which are also incorporated herein by reference. Other suitable thermoplastic elastomer materials or films include polyurethane, polyester, polyester polyurethane, polyether polyurethane, such as cast or extruded ester-based polyurethane film. Additional suitable materials are disclosed in U.S. Pat. Nos. 4,183,156 and 4,219,945 to Rudy. Among the numerous thermoplastic urethanes that are suitable for forming bladder 8 are urethanes such as Pellethane, a product of the Dow Chemical Company; Elastollan, a product of the BASF Corporation; and Estane, a product of the B.F. Goodrich Company, all of which are either ester or ether based. Still other thermoplastic urethanes based on polyesters, polyethers, polycaprolactone, and polycarbonate macrogels may be employed. Nitrogen blocking barrier materials may also be utilized. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; 6,321,465; and 6,391,405 to Bonk et al., each of which are also incorporated herein by reference.

The fluid contained by bladder 8 may vary to include any of the disclosed fluids in U.S. Pat. No. 4,340,626 to Rudy, such as hexafluoroethane and sulfur hexafluoride, for example. In addition, bladder 8 may include nitrogen gas or air at a desired pressure level. In some applications, the pressure of the gas contained by bladder 8 may be at ambient pressure. In addition, a pump system may be employed that permits the individual to selectively pressurize bladder 8 to a desired pressure.

Chamber 12 is formed of a first longitudinal chamber 16, and a second longitudinal chamber 18, which is spaced apart from and extends substantially parallel to first longitudinal chamber 16. A plurality of transverse chambers 20 extends between first and second longitudinal chambers 16, 18. A first end 22 of each transverse chamber 20 is connected to and in fluid communication with first longitudinal chamber 16. Correspondingly, a second end 24 of each transverse chamber 20 is connected to and in fluid communication with second longitudinal chamber 18. Thus, chamber 12 is a contiguous chamber formed of longitudinal chambers 16, 18 and the plurality of transverse chambers 20, all in fluid communication with one another.

A longitudinal axis C of each transverse chamber 20 is substantially parallel to the longitudinal axis C of each of the other transverse chambers 20. In a preferred embodiment, each longitudinal axis C is disposed at an angle $\beta$ with respect to a longitudinal axis L of bladder 8. In a preferred embodiment, angle $\beta$ may be between approximately 1° and approximately 89°, more preferably between approximately 35° and approximately 60°, and most preferably approximately 50°.

An elongate transverse aperture 26 is disposed between each adjacent pair of transverse chambers 20. A longitudinal axis A of each elongate transverse aperture 26 is substantially parallel to the longitudinal axis A of each of the other elongate transverse apertures 26. In a preferred embodiment, each longitudinal axis A is disposed at an angle $\alpha$ with respect to longitudinal axis L of bladder 8. In a preferred embodiment, angle $\alpha$ may be between approximately 1° and approximately 89°, more preferably between approximately 35° and approximately 60°, and most preferably approximately 50°.

Elongate first and second flange apertures 28, 30 are positioned in opposite ends of flange 14, each located proximate an endmost transverse chamber 20. First and second apertures 28, 30 each have a longitudinal axis B that is substantially parallel to the longitudinal axis B of the other aperture. In a preferred embodiment, each longitudinal axis B is disposed at an angle Δ with respect to longitudinal axis L of bladder 8. In a preferred embodiment, angle Δ may be between approximately 1° and approximately 89°, more preferably between approximately 35° and approximately 60°, and most preferably approximately 50°.

Figure 3:
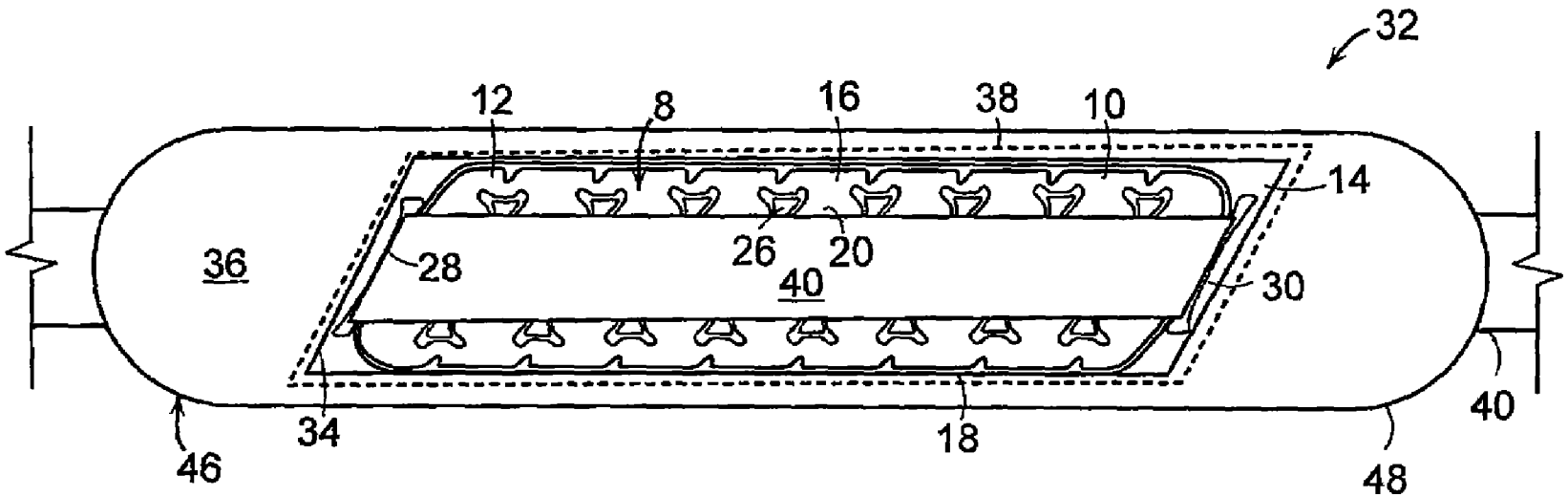
FIG. 3 is a plan view of the fluid-filled bladder of FIG. 1, shown secured within an aperture of a pad of a strap assembly.
Figure 4:
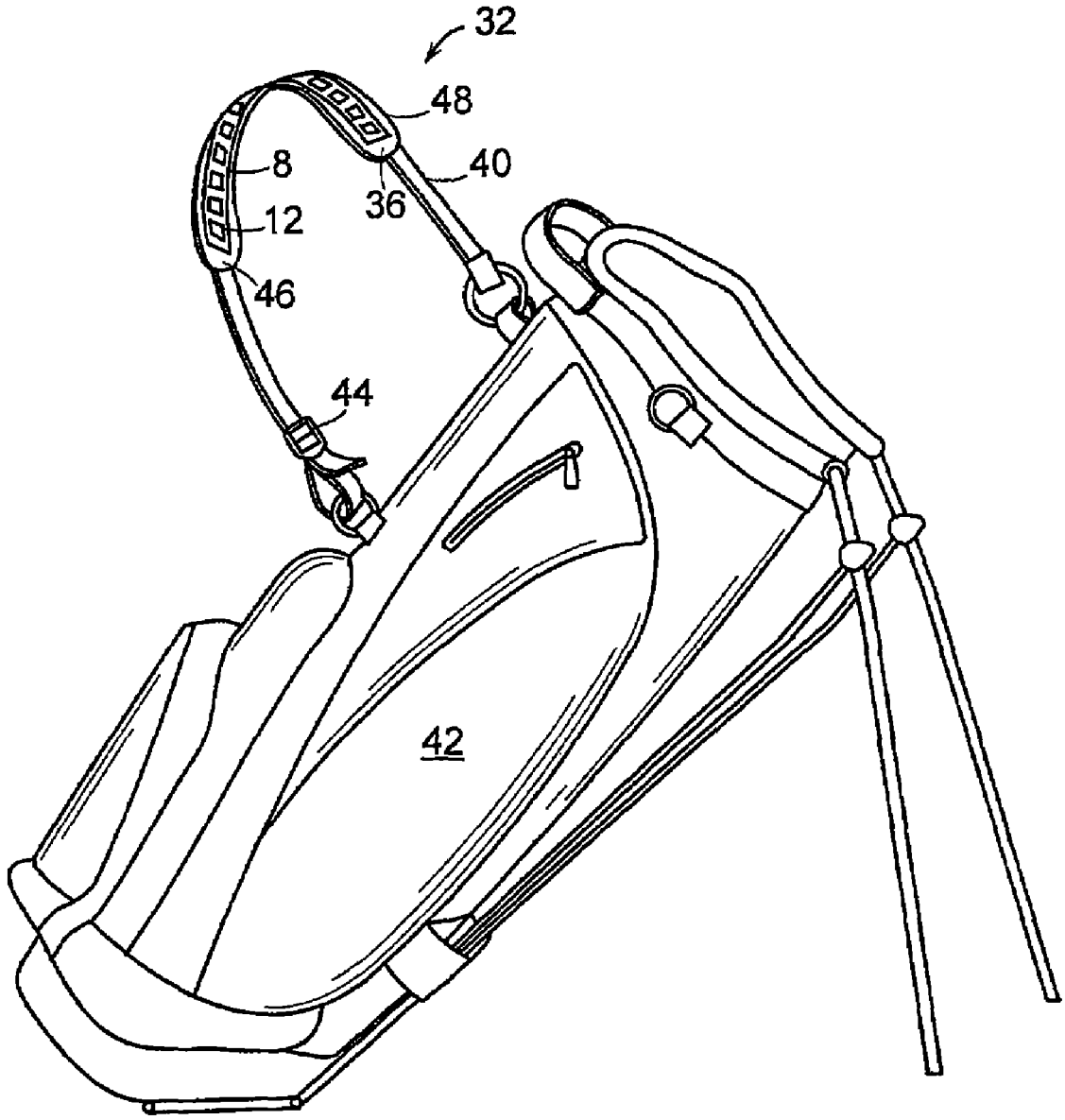
FIG. 4 is a perspective view of a bag with a strap incorporating the fluid-filled bladder of FIG. 1.

As seen in FIG. 3, a strap assembly 32 comprises a bladder 8 positioned within an aperture 34 formed in a pad 36. Flange 14 of bladder 8 is secured to pad 36 by stitching 38, or other suitable fastening means. An elongate length of webbing 40 is connected to pad 36 and secured at opposed ends thereof to a bag 42, as seen in FIG. 4 that is to be carried by a user, typically on the user's shoulder. Strap assembly 32 may have an adjustable buckle 44, or other suitable fastening means, e.g., a hook and loop fastener, that allows the length of strap assembly 32 to be adjusted.

In the embodiment illustrated in FIG. 4, bag 42 is a golf bag. However, it is to be appreciated that strap assembly 32 may be used with any bag designed to carry a load, including, but not limited to backpacks, messenger bags, and duffel bags. Other bags to which strap assembly 32 can be secured will become readily apparent to those skilled in the art, given the benefit of this disclosure.

By positioning bladder 8 with its chamber 12 within a central portion of strap assembly 32, a user is provided with a substantial cushion to help support the load carried in bag 42.

In the embodiment illustrated in FIG. 3, looking from left to right, webbing 40 extends along a first side 46 of pad 36 (not visible since it is the underside in this view) and passes through first aperture 28. Webbing 40 then extends along a second side 48 of pad 36, passing transverse chambers 20 of chamber 12, and passes through second aperture 30. Webbing 40 then continues along first side 46, past the end of pad 36 and on to bag 42. Thus, webbing 40 is connected to pad 36 by being woven through first and second apertures 28, 30 in bladder 8. The woven construction provides adjustability for strap assembly 32. Since pad 36, and, therefore, bladder 8 is secured to webbing 40 by weaving, it is possible to position pad 36 and bladder 8 at any desired position along webbing 40 of strap assembly 32, allowing a user to optimize the location of the cushioning effect of bladder 8.

The illustrated embodiment shows eight transverse apertures 26, however, it is to be appreciated that the number of apertures in bladder 8 may vary, and may be greater or less than the eight illustrated here. The number of apertures may vary based on the size of bladder 8, the desired size of transverse apertures 26 and the size of webbing 40.

In a preferred use, strap assembly 32 is positioned on a user's shoulders such that chamber 12 is in contact with the user's shoulder. That is, webbing 40 is positioned above chamber 12 with respect to the user's shoulder. Thus, in the embodiment illustrated in FIGS. 3-4, a user would place first side 46 against their shoulder. The weight of the load in bag 42 is carried by webbing 40 and, therefore, produces a downward force on webbing 40, which in turn is transmitted to chamber 12. As chamber 12 is compressed, it advantageously distributes the load incurred by strap 38 evenly throughout chamber 12, primarily outwardly toward longitudinal chambers 16, 18. This pressure distribution provides additional comfort for the wearer, allowing them to carry more weight with less discomfort.

In a preferred embodiment, webbing 40 is formed of nylon, however, it is to be appreciated that many materials will be suitable for webbing 40 including natural and synthetic materials.

Figure 5:
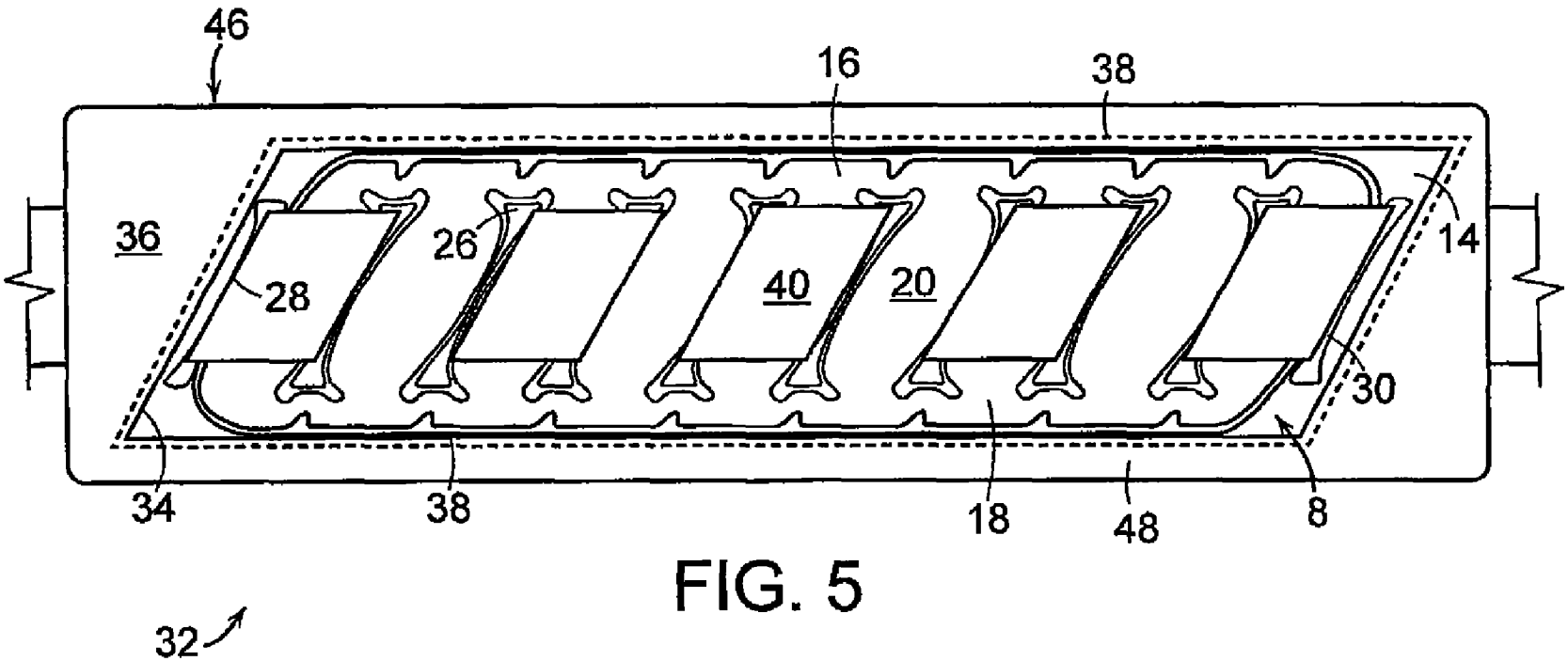
FIG. 5 is a plan view of the fluid-filled bladder of FIG. 1, shown secured within an aperture of a pad of a strap assembly, with a web of the strap assembly shown woven through the fluid-filled bladder.

In another preferred embodiment, as illustrated in FIG. 5, webbing 40 is woven through transverse apertures 26 in chamber 12 in addition to being woven through first and second apertures 28, 30. In the illustrated embodiment, webbing 40 is woven through each transverse aperture 26 in alternating fashion. This weaving configuration secures webbing 40 to bladder 8 as well as pad 36, and helps to distribute a load across the weight bearing portion of strap assembly 32. It is to be appreciated that webbing 40 may be woven through transverse apertures 26 in other configurations as well. For example, webbing 40 may span across more than one transverse chamber 20 between a pair of transverse apertures 26 through which webbing 40 passes. This allows a user to customize how weight is distributed along strap assembly 32. For example, in one embodiment, webbing 40 might pass through every other transverse aperture 26. In another embodiment in which there are eight transverse apertures 26 and nine transverse chambers 20, webbing 40 might pass over the first two transverse chambers, under the next three transverse chambers, over the next three transverse chambers, and then over the final transverse chamber. Consequently, any configuration of weaving webbing 40 through transverse apertures 26 is considered to be within the scope of the invention.

Figure 6:
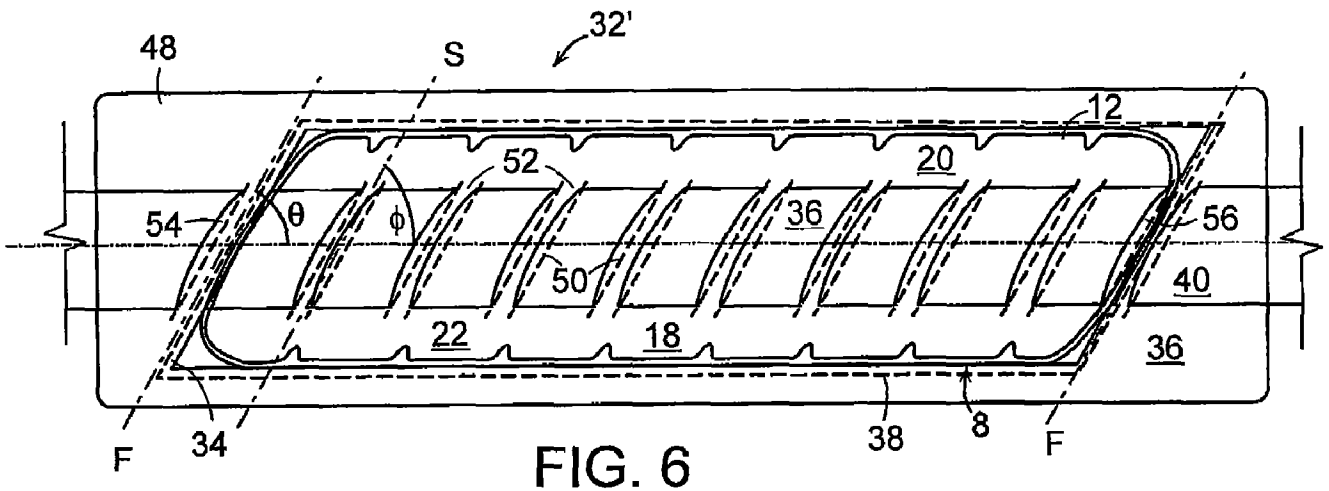
FIG. 6 is a plan view of an alternative embodiment of a fluid-filled bladder in accordance with the present invention.

In another preferred embodiment, as illustrated in FIG. 6, a strap assembly 32' includes a plurality of pairs of parallel slits 50 in bladder 8 that define a plurality of transverse straps 52. Transverse straps 52 extend from first longitudinal chamber 16 to second longitudinal chamber 18. A longitudinal axis S of each transverse strap 52 is substantially parallel to the longitudinal axis S of the other transverse straps. In a preferred embodiment, each longitudinal axis S is disposed at an angle ϕ with respect to longitudinal axis L of bladder 8. In a preferred embodiment, angle ϕ may be between approximately 1° and approximately 89°, more preferably between approximately 35° and approximately 60°, and most preferably approximately 55°.

Elongate first and second flange straps 54, 56 are positioned in opposite ends of flange 14, each located proximate an endmost transverse chamber 20. A longitudinal axis F of each of first and second flange straps 54, 56 are substantially parallel to the longitudinal axis F of the other strap. In a preferred embodiment, each longitudinal axis F is disposed at an angle θ with respect to longitudinal axis L of bladder 8. In a preferred embodiment, angle θ may be between approximately 1° and approximately 89°, more preferably between approximately 35° and approximately 60°, and most preferably approximately 50°.

Figure 7:
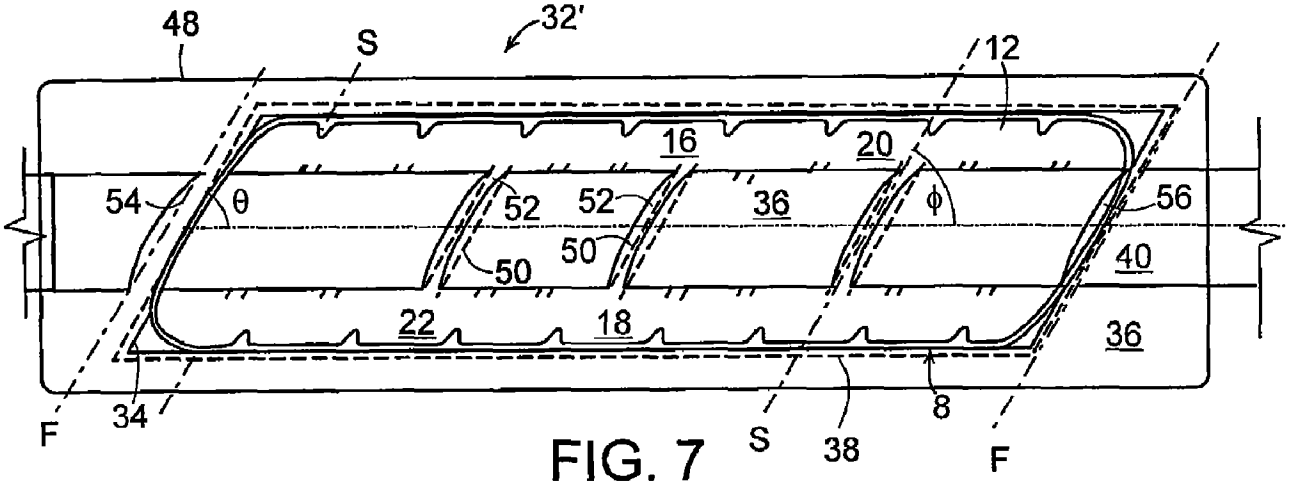
FIG. 7 is a plan view of the fluid-filled bladder of FIG. 6, shown with the webbing woven through only some of the straps of the bladder.

In this embodiment, webbing 40 extends along second side 48 of pad 36, passing under at least some of transverse straps 52 and flange straps 54, 56. In a preferred embodiment, webbing 40 passes under each transverse strap 52 and both flange straps 54, 56. Transverse straps 52 and flange straps 54, 56 work with webbing 40 to safely secure bladder 8 and pad 36 to webbing 40, while at the same time providing the flexibility to move pad 36, as well as bladder 8, along webbing 40 to a desired location. In the embodiment shown in FIG. 7, webbing 40 passes through only three of the transverse straps 52.

Figure 11:
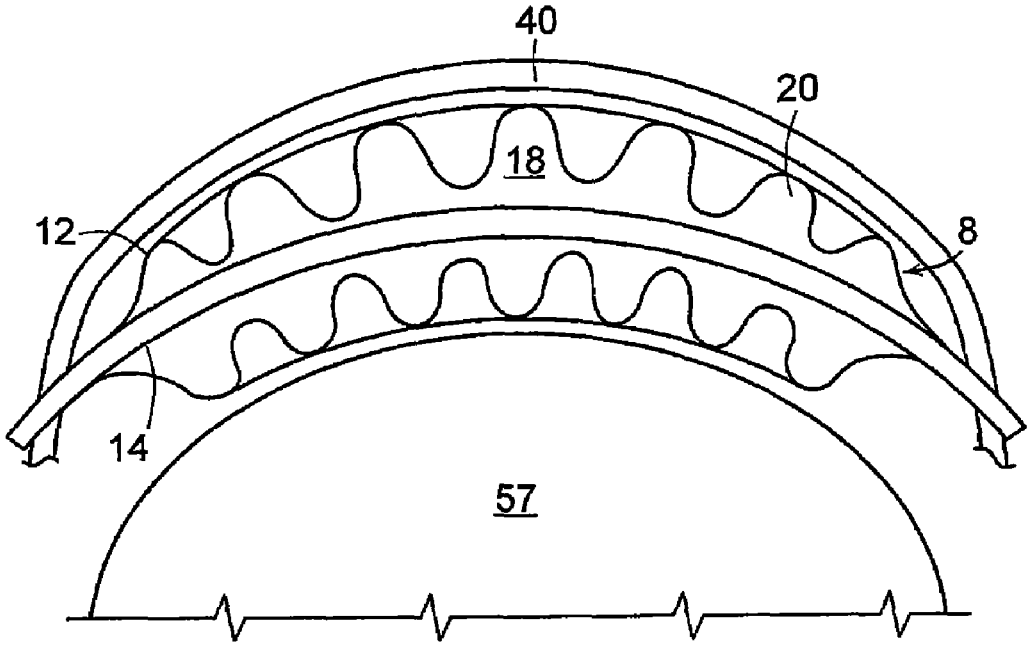
FIG. 11 is a schematic side view illustration of a shoulder strap incorporating the fluid-filled bladder of the present invention, showing compression of the bladder on the user's shoulder.

Regardless of how webbing 40 is secured to bladder 8, i.e., whether webbing 40 is woven through transverse apertures 26 in chamber 12, or through transverse straps 52, by positioning bladder 8 between webbing 40 and the user's shoulder, webbing 40 can act as a compression strap, as seen in FIG. 11, with bladder 8 acting as a conformable interface between the load, which is carried by webbing 40, and the user's shoulder 57. This allows efficient distribution of the air in chamber 12 in response to the force of the load on the user's shoulder.

Figure 8:
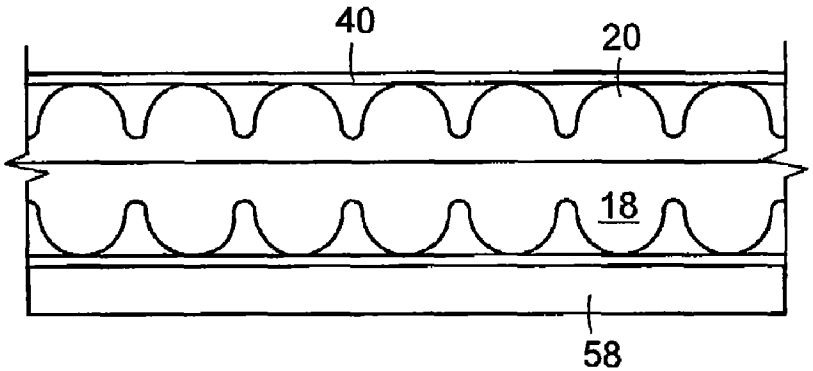
FIG. 8 is an elevation view of part of a strap in accordance with the present invention, showing the webbing, bladder and a layer of compressible material.

In certain preferred embodiments, as seen in FIG. 8, a layer of compressible material 58, such as foam padding, is positioned in pad 36, on the side of bladder 8 opposite webbing 40. Consequently, compressible material 58 is positioned between bladder 8 and the user's shoulder, providing yet another layer of conformable material between the load carried by webbing 40 and the user's shoulder.

Figure 9:
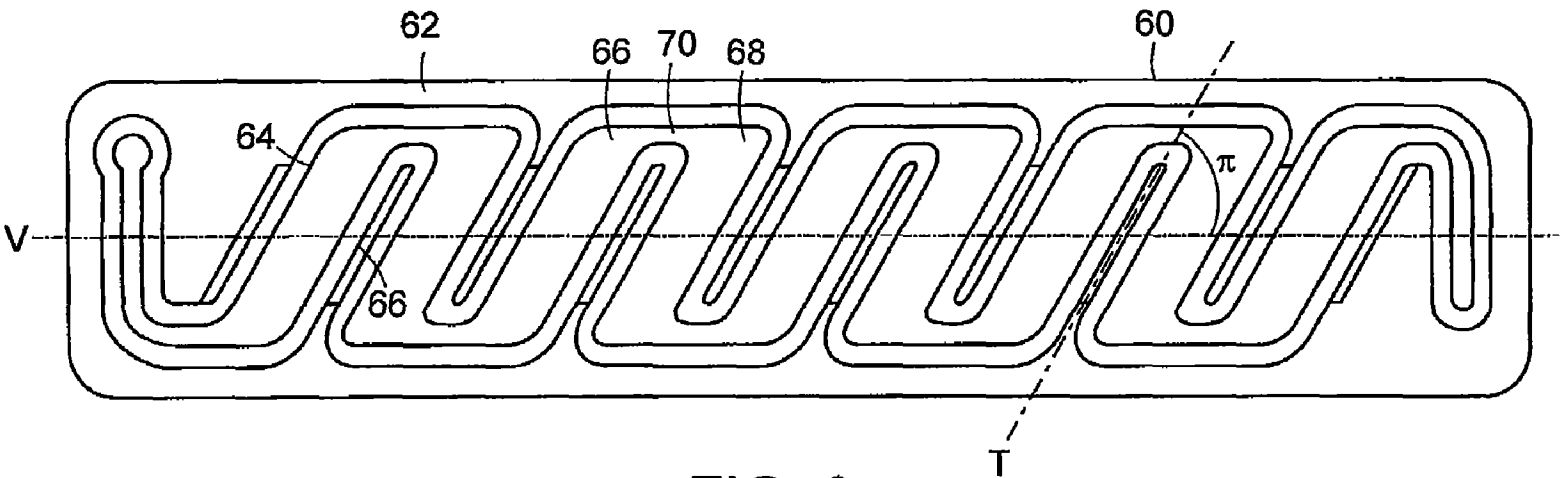
FIG. 9 is a plan view of an alternative embodiment of a fluid-filled bladder in accordance with the present invention.

Another preferred embodiment of a bladder 60 is shown in FIG. 9. Bladder 60 has a flange 62 surrounding chamber 64. Chamber 64 is formed of a plurality of transverse chambers 66. Ends 68 of transverse chambers 66 are connected to and in fluid communication adjacent transverse chambers 66 by way of corresponding longitudinal chambers 70 that extend substantially parallel to a longitudinal axis V bladder 60. Thus, transverse chambers 66 and longitudinal chambers 70, all of which are in fluid communication with one another, combine to form a single contiguous serpentine chamber 64.

A plurality of transverse apertures 72 are formed in bladder 60. Each aperture 72 is positioned between adjacent transverse chambers 66. A longitudinal axis T of each aperture 72 is substantially parallel to the longitudinal axis T of the other apertures 72. In a preferred embodiment, each longitudinal axis T is disposed at an angle $\pi$ with respect to longitudinal axis V of bladder 60. In a preferred embodiment, angle $\pi$ may be between approximately 1° and approximately 89°, more preferably between approximately 35° and approximately 60°, and most preferably approximately 50°.

As noted above, longitudinal axis A of each transverse aperture 26 is disposed at angle $\alpha$ with respect to longitudinal axis L of bladder 8; longitudinal axis B of first and second apertures 28, 30 is disposed at an angle $\Delta$ with respect to longitudinal axis L of bladder 8; longitudinal axis S of each transverse strap 52 is disposed at angle $\phi$ with respect to longitudinal axis L of bladder 8; longitudinal axis F of each of flange straps 54, 56 is disposed at angle $\theta$ with respect to longitudinal axis L of bladder 8, and longitudinal axis T of each of aperture 72 is disposed at angle $\pi$ with respect to longitudinal axis V of bladder 60. Angling transverse apertures 26, first and second apertures 28, 30, transverse straps 52, flange straps 54, 56, and apertures 72 provides a desired twist or curve in strap assembly 32 when webbing 40 is woven therethrough.

Figure 10B:
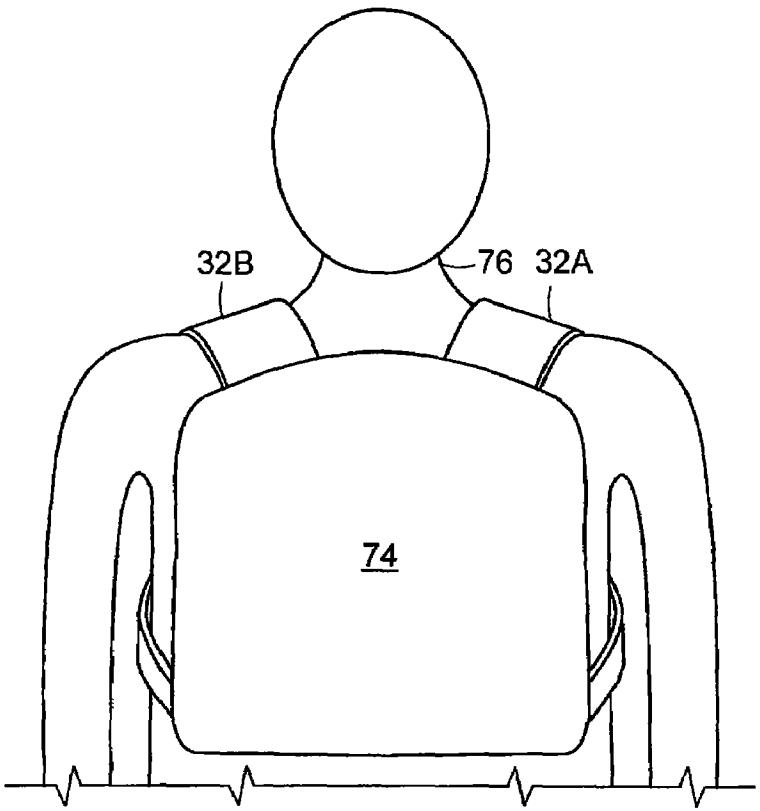
FIGS. 10A-B are front and rear elevation views, respectively, of a shoulder strap assembly incorporating the fluid-filled bladder of the present invention shown securing a backpack to a user's shoulders.
Figure 10A:
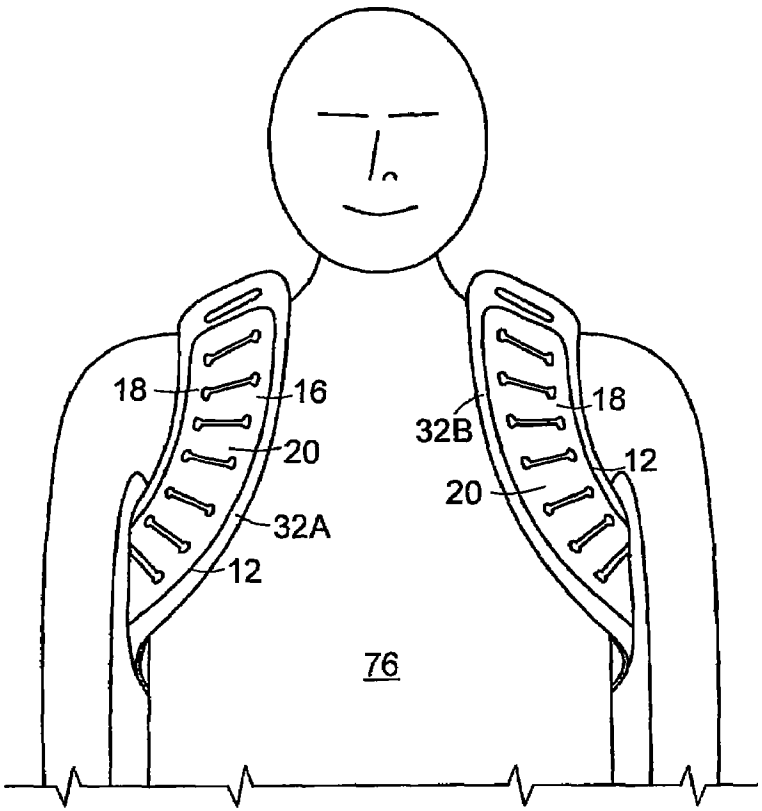

The resultant twist or curve of a strap assembly is illustrated in FIGS. 10A-B, where two strap assemblies 32A and 32B are shown securing a backpack 74 to the back of a person 76. Each strap assembly is a mirror image of the other, with the outer side of strap assemblies 32A 32B, that is, the sides of the straps not in contact with the wearer, being visible in this drawing. By angling the apertures or straps of the bladders as seen here, that is, downwardly from the inner side of a strap toward the outer side, the strap assembly is twisted appropriately to wrap around the user's shoulders. Strap assemblies 32A and 32B are especially suitable for use on a backpack, since the natural twist or curve of the strap assemblies provide an excellent ergonomic fit about the shoulders of a wearer. As seen here, a suitable strap assembly 32A for the user's right shoulder is provided, while a corresponding suitable strap assembly 32B is provided for the user's left shoulder.

Figure 12:
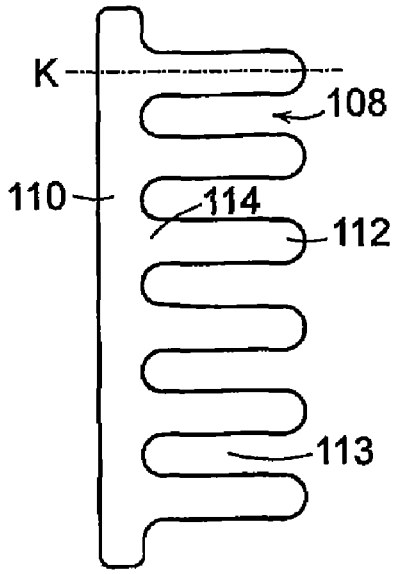
FIG. 12 is a plan view of an alternative embodiment of a fluid-filled bladder in accordance with the present invention.

It is to be appreciated that bladders in accordance with the present invention can take on many shapes. A number of examples of additional preferred embodiments are schematically illustrated in FIGS. 12-15. As seen in FIG. 12, a bladder 108 may be formed of a longitudinal chamber 110 and a plurality of transverse chambers 112 spaced apart from one another by a gap 113. A first end 114 of each transverse chamber 112 is connected to and in fluid communication with longitudinal chamber 110. Thus each of the transverse chambers is in fluid communication with each of the others by way of longitudinal chamber 110. A longitudinal axis K of each aperture 72 is substantially parallel to the longitudinal axis K of the other apertures 72

Figure 13:
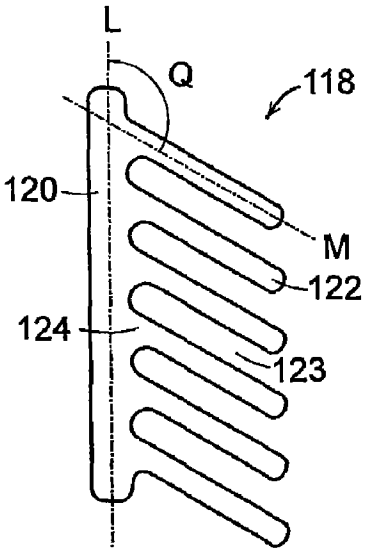
FIG. 13 is a plan view of another alternative embodiment of a fluid-filled bladder in accordance with the present invention.

Another preferred embodiment is shown in FIG. 13, where a bladder 118 comprises a longitudinal chamber 120 and a plurality of transverse chambers 122 spaced apart from one another by a gap 123. A first end 124 of each transverse chamber 122 is connected to and in fluid communication with longitudinal chamber 120. Thus each of transverse chambers 122 is in fluid communication with each of the others by way of longitudinal chamber 120. A longitudinal axis M of each transverse chamber 122 is substantially parallel to the longitudinal axis M of the other transverse chambers 122. In a preferred embodiment, each longitudinal axis M is disposed at an angle Q with respect to longitudinal axis L of bladder 120. In a preferred embodiment, angle Q may be between approximately 1° and approximately 89°, more preferably between approximately 35° and approximately 60°, and most preferably approximately 50°.

Figure 14:
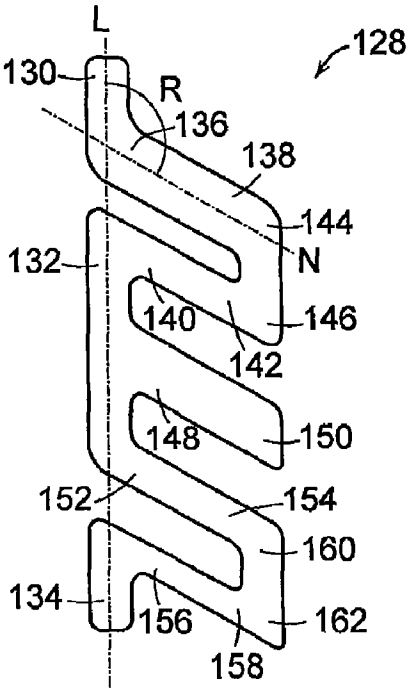
FIG. 14 is a plan view of a further alternative embodiment of a fluid-filled bladder in accordance with the present invention.

Another preferred embodiment is shown in FIG. 14, in which a bladder 128 is formed of three longitudinal chambers 130, 132, 134, each of which is coaxial with one another and sharing a longitudinal axis L. A plurality of transverse chambers spaced apart from one another by a gap are connected to and in fluid communication with a longitudinal chamber. A first end 136 of a first transverse chamber 138 is connected to and in fluid communication with first longitudinal chamber 130. A first end 140 of a second transverse chamber 142 is connected to and in fluid communication with second longitudinal chamber 132. A second end 144 of first transverse chamber 138 is connected to and in fluid communication with a second end 146 of second transverse chamber 142.

A first end 148 of a third transverse chamber 150 is connected to and in fluid communication with second longitudinal chamber 132. A first end 152 of a fourth transverse chamber 154 is connected to and in fluid communication with second transverse chamber 132. A first end 156 of a fifth transverse chamber 158 is connected to and in fluid communication with third longitudinal chamber 134. A second end 160 of fourth transverse chamber 154 is connected to and in fluid communication with a second end 162 of fifth transverse chamber 158. This embodiment has a substantially serpentine shape, with the addition of one transverse chamber (transverse chamber 150) that is not part of the serpentine shape.

Figure 15:
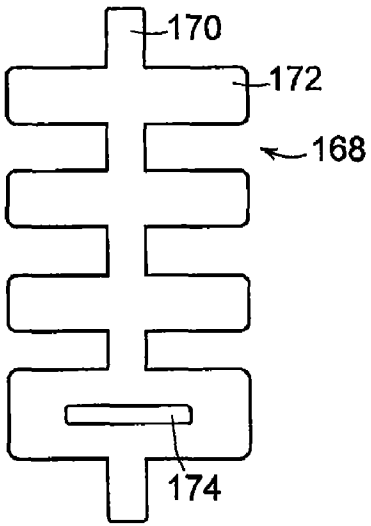
FIG. 15 is a plan view of yet another alternative embodiment of a fluid-filled bladder in accordance with the present invention.

Another preferred embodiment is shown in FIG. 15, in which a bladder 168 has a longitudinal chamber 170 and a plurality of transverse chambers 172. Each transverse chamber extends across longitudinal chamber 170 in an intersecting T fashion. One or more transverse chambers 172 may have an elongate aperture 174 formed therein.

A longitudinal axis N of each transverse chamber is substantially parallel to the longitudinal axis N of the other transverse chambers. In a preferred embodiment, each longitudinal axis N is disposed at an angle R with respect to longitudinal axis L of bladder 128. In a preferred embodiment, angle R may be between approximately 1° and approximately 89°, more preferably between approximately 35° and approximately 60°, and most preferably approximately 50°.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A bladder for use with a strap to carry a load comprising, in combination:

at least one longitudinal chamber;

a plurality of transverse chambers, each transverse chamber being connected at a first end thereof to the at least one longitudinal chamber, being in fluid communication with the at least one longitudinal chamber and each other transverse chamber, and having a longitudinal axis extending substantially parallel to the longitudinal axis of the other transverse and at an acute angle with respect to a longitudinal axis of the bladder, the plurality of transverse chambers being the only chambers connected to and in fluid communication with the first and second longitudinal chambers, the transverse chambers and the at least one longitudinal chamber defining a sealed bladder free of any openings; and a plurality of apertures, each aperture being disposed between adjacent transverse chambers serving to space adjacent transverse chambers from one another, and having a longitudinal axis extending substantially parallel to a longitudinal axis of each of the transverse apertures.

2. The bladder of claim 1, further comprising a means for providing a twist in the bladder.

3. A bladder for use with a strap to carry a load comprising, in combination:

a first longitudinal chamber;

a second longitudinal chamber spaced apart from and substantially parallel to the first longitudinal chamber;

a plurality of transverse chambers, each transverse chamber being connected at a first end thereof to the first longitudinal chamber and at a second end thereof to the second longitudinal chamber, in fluid communication with the first and second longitudinal chambers, and having a longitudinal axis extending substantially parallel to the longitudinal axis of the other transverse chambers, the plurality of transverse chambers being the only chambers connected to and in fluid communication with the first and second longitudinal chambers, the transverse chambers and first and second longitudinal chambers defining a sealed bladder free of any openings; and a plurality of elongate transverse apertures, each transverse aperture disposed between adjacent transverse chambers and having a longitudinal axis extending substantially parallel to a longitudinal axis of each of the other transverse apertures;

wherein the longitudinal axis of each transverse chamber is disposed at an acute angle with respect to a longitudinal axis of the bladder.

4. The bladder of claim 3, wherein the longitudinal axis of each transverse aperture is disposed at an acute angle with respect to a longitudinal axis of the bladder.

5. The bladder of claim 3, further comprising a plurality of elongate transverse straps, each strap disposed between adjacent transverse chambers, being formed by a pair of substantially parallel slits formed in the bladder, and having a longitudinal axis extending substantially parallel to a longitudinal axis of each of the other elongate straps.

6. The bladder of claim 5, wherein the longitudinal axis of each elongate strap is disposed at an angle with respect to a longitudinal axis of the bladder.

7. The bladder of claim 3, further comprising a flange portion surrounding the first and second longitudinal chambers.

8. The bladder of claim 7, further comprising an elongate first flange aperture formed in the flange portion proximate an endmost transverse chamber; and an elongate second flange aperture formed in the flange proximate an opposed endmost transverse chamber and having a longitudinal axis extending substantially parallel to a longitudinal axis of the first flange aperture.

9. The bladder of claim 8, wherein the longitudinal axis of each of the first and second flange apertures is disposed at an acute angle with respect to a longitudinal axis of the bladder.

10. A strap for a device carrying a load comprising, in combination:

a pad having a central aperture formed therein;

a fluid-filled bladder positioned within the central aperture and secured to the pad and including a plurality of transverse chambers, each chamber having a longitudinal axis disposed at an acute angle with respect to a longitudinal axis of the bladder, the bladder being sealed and free of any openings and comprising:

a first longitudinal chamber; and a second longitudinal chamber spaced apart from and substantially parallel to the first longitudinal chamber;

wherein each transverse chamber is connected at a first end thereof to the first longitudinal chamber and at a second end thereof to the second longitudinal chamber, in fluid communication with the first and second longitudinal chambers, and has a longitudinal axis extending substantially parallel to the longitudinal axis of the other transverse chambers, the plurality of transverse chambers being the only chambers connected to and in fluid communication with the first and second longitudinal chambers, a plurality of elongate transverse apertures, each transverse aperture disposed between adjacent transverse chambers and having a longitudinal axis extending substantially parallel to a longitudinal axis of each of the other transverse apertures; and a length of webbing slidably connected to first and second ends of the pad.

11. The strap of claim 10, wherein the longitudinal axis of each transverse aperture is disposed at an acute angle with respect to a longitudinal axis of the bladder.

12. The strap of claim 10, wherein the webbing is woven through at least one of the transverse apertures.

13. The strap of claim 10, further comprising a layer of compressible material positioned adjacent the bladder.

14. The strap of claim 10, further comprising a plurality of elongate transverse straps, each strap disposed between adjacent transverse chambers, being formed by a pair of substantially parallel slits formed in the bladder, and having a longitudinal axis extending substantially parallel to a longitudinal axis of each of the other elongate straps.

15. The strap of claim 14, wherein the longitudinal axis of each elongate strap is disposed at an angle with respect to a longitudinal axis of the bladder.

16. The strap of claim 14, wherein the web passes between the bladder and at least some of the straps.

17. The strap of claim 10, further comprising a flange portion surrounding the first and second longitudinal chambers.

18. The strap of claim 17, wherein the flange portion is secured to the pad.

19. The strap of claim 17, wherein the flange portion is sewn to the pad.

20. The strap of claim 17, further comprising an elongate first flange aperture formed in the flange portion proximate an endmost transverse chamber; and an elongate second flange aperture formed in the flange proximate an opposed endmost transverse chamber and having a longitudinal axis extending substantially parallel to a longitudinal axis of the first flange aperture.

21. The strap of claim 20, wherein the longitudinal axis of each of the first and second flange apertures is disposed at an acute angle with respect to a longitudinal axis of the bladder.

22. A bag carrying device comprising, in combination:

a bag;

a length of webbing connected at opposed ends thereof to the bag;

a pad having a central aperture formed therein, the length of webbing slidably secured to first and second ends of the pad;

a fluid-filled bladder positioned within the central aperture and secured to the pad, the bladder being sealed and free of any openings and comprising a first longitudinal chamber;

a second longitudinal chamber spaced apart from and substantially parallel to the first longitudinal chamber; and a plurality of transverse chambers, each transverse chamber being connected at a first end thereof to the first longitudinal chamber and at a second end thereof to the second longitudinal chamber, in fluid communication with the first and second longitudinal chambers, and having a longitudinal axis extending substantially parallel to the longitudinal axis of the other transverse chambers, the plurality of transverse chambers being the only chambers connected to and in fluid communication with the first and second longitudinal chambers;

a flange portion surrounding the first and second longitudinal chambers and secured to the pad;

a plurality of elongate transverse apertures, each transverse aperture disposed between adjacent transverse chambers and having a longitudinal axis extending substantially parallel to a longitudinal axis of each of the other transverse apertures and at an acute angle with respect to a longitudinal axis of the bladder.

* * * * *